United States Patent [19]

Fahmy

[11] 4,370,660

[45] Jan. 25, 1983

[54] BROADBAND ELLIPTIC SHEET ANTENNA

[76] Inventor: Moustafa N. I. Fahmy, Ammariya Building, (Flat 46), Al-Batt'ha St., Riyadh, Saudi Arabia

[21] Appl. No.: 906,672

[22] Filed: May 17, 1978

[51] Int. Cl.[3] ..... H01Q 9/28

[52] U.S. Cl. ..... 343/795; 343/830

[58] Field of Search ..... 343/793, 795, 807, 821, 343/822, 830–832, 846

[56] References Cited

U.S. PATENT DOCUMENTS

| | | | |
|---|---|---|---|
| 2,939,143 | 5/1960 | Zisler | 343/807 |
| 3,364,491 | 1/1968 | Stohr | 343/821 |
| 3,475,758 | 10/1969 | De Vito | 343/795 |

*Primary Examiner*—Eli Lieberman

[57] ABSTRACT

A broadband antenna in either the monopole or dipole configuration has an impedance broadbanding potentiality superior to those of known broadband antennas such as the triangular, helical and log-periodic antennas. Compared with the forementioned antennas in corresponding operating frequency ranges (expressed by the ratio of maximum to minimum frequency), the 'Elliptic sheet antenna' has the merits of: (i) markedly lower variation of input resistance ($R_{in}$) as expressed by the ratio of maximum-to-minimum of $R_{in}$, (ii) markedly lower values of input reactance ($X_{in}$) and lower reactive content in the impedance, as expressed by the ratio $|X_{in}|/|Z_{in}|$, (iii) preferable input resistance level, being nearly matched to that of the Standard 50 Ohms coaxial line, when the new antenna is used in the monopole configuration, (iv) wider operating frequency range if determined by a maximum tolerable standing wave ratio (SWR) as is specified in television, (v) lower SWR for equal frequency ranges.

The merits of the new antenna reduce the main drawbacks of the other antenna, namely: (i) reflection loss and the corresponding variation with frequency of radiated power for a constant transmitter power, (ii) complex matching networks and power loss therein, (iii) limitation of frequency range of a single antenna when a tolerable maximum SWR is specified; more than one antenna should be used for broader frequency ranges. The antenna geometry and construction are simpler than with the other broadband antennas. The elliptic sheet antenna may be used either as a single element, or as a member of an array.

3 Claims, 5 Drawing Figures

DETAILS OF THE INPUT REGION AND COAXIAL FEED OF ELLIPTIC SHEET MONOPOLE ANTENNA

DIPOLE

MONOPOLE

SCHEMATIC OF THE POSSIBLE CONFIGURATIONS OF THE ELLIPTIC SHEET ANTENNA

DETAILS OF THE INPUT REGION AND COAXIAL FEED OF ELLIPTIC SHEET MONOPOLE ANTENNA

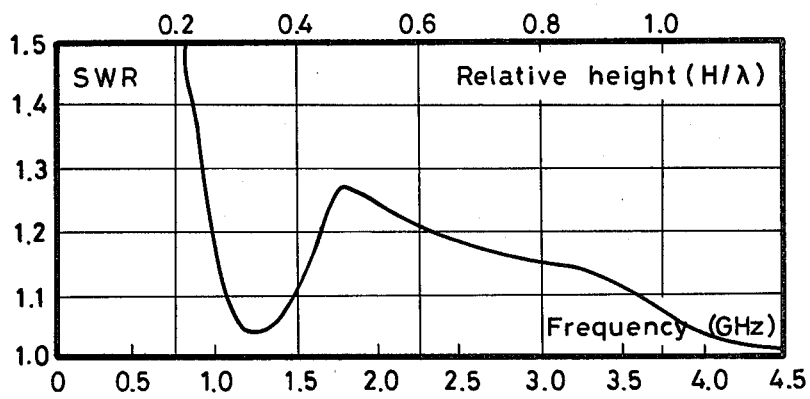
FIG. 4 MEASURED SWR ON A 50 Ω COAXIAL FEED FOR A 10 x 8 ELLIPTIC SHEET ANTENNE
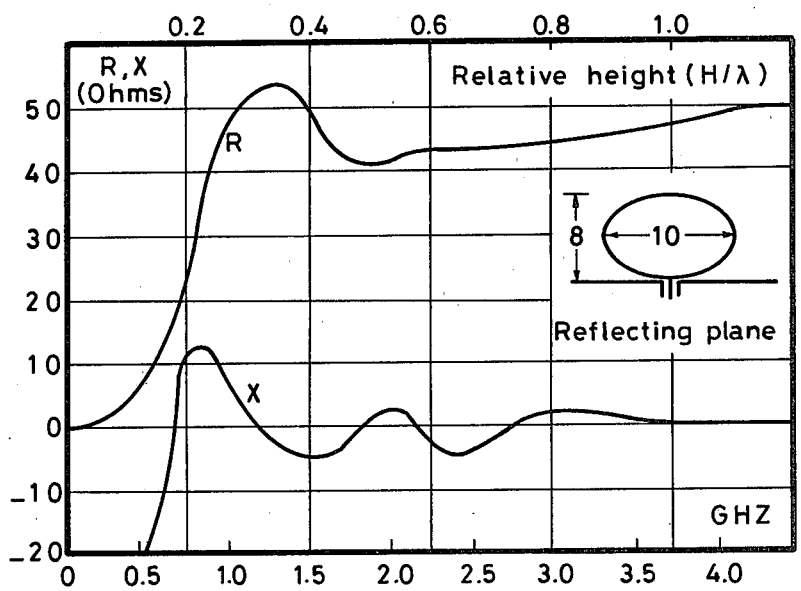
FIG. 5 MEASURED INPUT IMPEDANCE OF ELLIPTIC SHEET ANTENNA

BROADBAND ELLIPTIC SHEET ANTENNA

BRIEF DESCRIPTION OF THE DRAWINGS

FIG. 4 is a graph of the measured SWR for the FIG. 1 antenna;

FIG. 5 is a graph of the measured input impedance for the FIG. 1 antenna.

DESCRIPTION

(i) The Experimental Model

Figure 2:
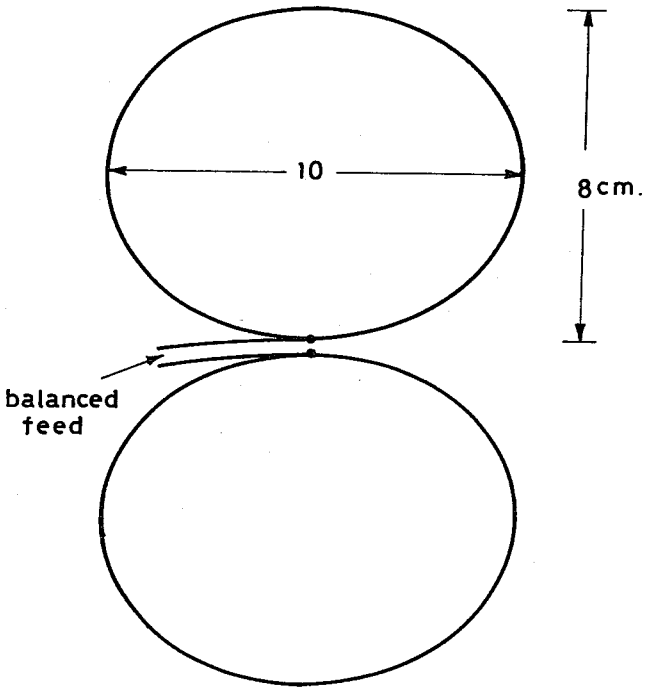
FIG. 2 shows an elliptic dipole radiator.
Figure 1:
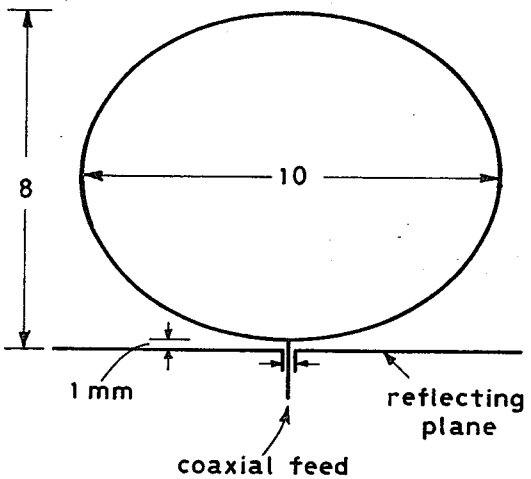
FIG. 1 shows an elliptic monopole radiator.
Figure 3:
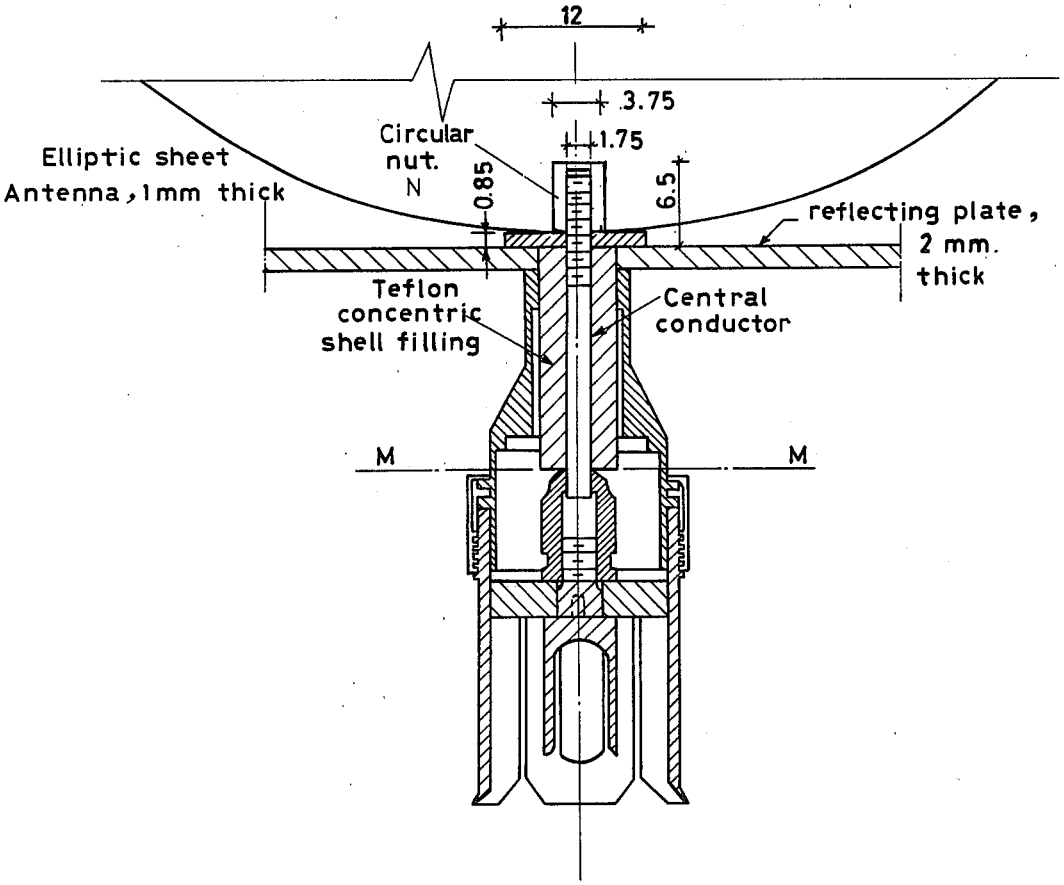
FIG. 3 shows the details of the electrical connection to the FIG. 1 antenna.

The elliptic sheet antenna may be used in either a monopole or a dipole configuration. In the monopole case the antenna is an elliptic sheet of eccentricity 0.8, mounted normal to a reflecting plane with its major axis parallel to that plane; the antenna is fed through a coaxial line, FIG. 1. In the dipole case, the antenna consists of two coplanar elliptic sheets of eccentricity 0.8 with collinear minor axes, the two sheets being slightly separated to accommodate a balanced feeding line, FIG. 2. The tested experimental model was a monopole elliptic sheet antenna 1 mm thick made of brass, with major and minor axes of 10 and 8 cms, respectively. The monopole was mounted above the center of a circular sheet of copper 140 cms in diameter. A coaxial feed cable coming from below the reflecting plane penetrates through a hole at its center to feed the monopole thereabove. Details of the antenna feed and input region are shown in FIG. 3. The device shown below the reflecting plane is just a General Radio 50Ω cable connector type 874-C58A with a slight modification above M—M. In that region the GR inner conductor is replaced by another one of diameter 1.75 mms and a concentric cylindrical shell of teflon is inserted as shown. The so-modified GR cable connector is cut at the level of the upper surface of the reflecting plane, leaving the upper threaded parts of the inner conductor fits through a nut N welded to the elliptic sheet with one of its sides coinciding with the elliptical perimeter. The antenna is separated from the reflector plane by a teflon washer 0.85 mm thick.

Now the signal generator is connected to the feeding device via a GR patch-cord and a precision 50Ω slotted line GR LB-900. The patch cord is so selected from a set of GR 874-R20A, R22A, cords as to have standing wave ratio (SWR) less than 1.07 in the measuring frequency range.

(ii) Performance

The standing-wave ratio and impedance measurements were in the frequency range 0.4–4.5 GHz (height to wavelength ratio H/λ from 0.107 to 1.2) for the elliptic sheet monopole described above; the results are shown in FIGS. 4 and 5, respectively. For normalization the figs, show the SWR and Z versus frequency as well as versus the antenna height-to-wavelength ratio (H/λ).

When used in DIPOLE configuration, the impedance scale of FIG. 5 is multiplied by 2 while the SWR characteristics apply for a 100Ω feeding line.

(iii) Comparative Performance Figures (a) Triangular antenna with 70° apical angle (having approximately same maximum horizontal and vertical dimensions) in the antenna height range from 0.35 wavelength and above.

| | Triangular | Elliptic |
|---|---|---|
| Maximum resistance $R_{max}$ (ohms) | 164 | 54 |
| Minimum resistance $R_{min}$ (ohms) | 77 | 42 |
| $R_{max}/R_{min}$ | 2.130 | 1.286 |
| Maximum reactance \|X\| (ohms) | 46 | 4 |
| Maximum reactance/resistance ratio | 37.7% | 8% |

(b) Helical antenna in its axial mode (1.7:1 frequency range)

| | Helical | Elliptic (0.706–1.2λ) |
|---|---|---|
| SWR | <1.5 | <1.18 |
| Maximum Resistance $R_{max}$ (ohms) | 220 | 50 |
| Minimum Resistance $R_{min}$ (ohms) | 90 | 43.5 |
| $R_{max}/R_{min}$ | 2.4 | 1.149 |
| Reactance Fluctuation (ohms) | +5 to +40 | −2 to +2.5 |

(c) A Typical Log-periodic Dipole Array operating in a 2:1 frequency range.

| | Log-periodic | Elliptic (0.6–1.2λ) |
|---|---|---|
| Feeder Impedance | 110 Ohms | 50 Ohms |
| Standing wave ratio | 1.2–2.5 | 1.015–1.1215 |

I claim:

1. A broadband monopole antenna comprising a conducting elliptical sheet having an eccentricity of 0.8, a ground plane spaced from said elliptical sheet parallel to the major axis and perpendicular to the minor axis, a 50 ohm coaxial cable feed line having an outer conductor connected to said ground plane and an inner conductor passing through a hole in said ground plane, an insulating washer surrounding said inner conductor, a circular nut welded to said elliptical sheet at said minor axis, said inner conductor being in threaded communication with said nut to feed power to said elliptical sheet and to maintain its position with respect to the ground plane.

2. The antenna of claim 1 wherein said insulating washer is made of Teflon and is 0.85 mm thick.

3. A broadband dipole antenna comprising a pair of coplanar elliptical sheets each having an eccentricity of 0.8 and arranged with the minor axis collinear, a circular nut welded to each elliptical sheet to lie generally within the contour of the sheet and to be in opposing relation along the minor axis, and a balanced feed line connected to said opposed nuts.

* * * * *